US008879778B2

(12) United States Patent
Yeom

(10) Patent No.: US 8,879,778 B2
(45) Date of Patent: Nov. 4, 2014

(54) ULTRA-SLIM SPEAKER UNIT CAPABLE OF IMPROVING LOW-PITCHED SOUND CHARACTERISTIC AND SOUND PRESSURE AND BOARD EQUIPPED WITH THE SAME

(76) Inventor: Kang-Moon Yeom, Seoul (KR)

( * ) Notice: Subject to any disclaimer, the term of this patent is extended or adjusted under 35 U.S.C. 154(b) by 118 days.

(21) Appl. No.: 13/597,755

(22) Filed: Aug. 29, 2012

(65) Prior Publication Data

US 2013/0051597 A1 Feb. 28, 2013

(30) Foreign Application Priority Data

Aug. 29, 2011 (KR) ..... 10-2011-0086318
May 3, 2012 (KR) ..... 10-2012-0047182

(51) Int. Cl.

| | |
|---|---|
| ***H04R 1/00*** | (2006.01) |
| ***H04R 9/04*** | (2006.01) |
| ***H04R 7/20*** | (2006.01) |
| *H04R 31/00* | (2006.01) |
| *H04R 9/06* | (2006.01) |

(52) U.S. Cl.

CPC ..... *H04R 7/20* (2013.01); *H04R 2499/15* (2013.01); *H04R 31/006* (2013.01); *H04R 9/046* (2013.01); *H04R 9/06* (2013.01)

USPC ..... 381/405; 381/404; 381/400; 381/396

(58) Field of Classification Search

USPC ..... 381/405

See application file for complete search history.

(56) References Cited

U.S. PATENT DOCUMENTS

| | | | | |
|---|---|---|---|---|
| 2007/0274542 | A1* | 11/2007 | Otomo | 381/150 |
| 2009/0060252 | A1* | 3/2009 | Funahashi | 381/400 |
| 2011/0075880 | A1* | 3/2011 | Kamimura et al. | 381/413 |

* cited by examiner

*Primary Examiner* — Davetta W Goins
*Assistant Examiner* — Amir Etesam
(74) *Attorney, Agent, or Firm* — Jefferson IP Law, LLP

(57) ABSTRACT

A speaker used as a household appliance is provided. The speaker has an ultra-slim structure suitable for an ultra-slim TV and is applied to a woofer speaker representing a superior low-pitched sound characteristic. The speaker has the ultra-slim structure and improves the low-pitched sound characteristic and sound pressure by increasing the amplitude. Outer appearances of a damper and a frame are changed to enlarge a diameter of a voice coil in comparison with an outer diameter of the speaker, the damper has a two-step structure such that a longitudinal amplitude of an upper side of the damper is increased to improve the low-pitched sound characteristic in a state in which a lower side of the damper is put on the frame, and a size of a vibration plate is enlarged to improve the low-pitched sound characteristic and sound pressure. A flat plate is used as the vibration plate.

14 Claims, 19 Drawing Sheets

ULTRA-SLIM SPEAKER UNIT CAPABLE OF IMPROVING LOW-PITCHED SOUND CHARACTERISTIC AND SOUND PRESSURE AND BOARD EQUIPPED WITH THE SAME

PRIORITY

This application claims the benefit under 35 U.S.C. §119 (a) of a Korean patent application filed on Aug. 29, 2011 in the Korean Intellectual Property Office and assigned Serial No. 10-2011-0086318 and on May 3, 2012 in the Korean Intellectual Property Office and assigned Serial No. 10-2012-0047182, the entire disclosure of which is hereby incorporated by reference.

BACKGROUND OF THE INVENTION

1. Field of the Invention

The present invention relates to a speaker used for home appliances. More particularly, the present invention relates to a woofer speaker having an ultra-slim structure suitable for an ultra-slim TV and representing a superior low-pitched sound characteristic.

The present invention is applicable for various speakers having ultra-slim structures and generating both low-pitched sound and high-pitched sound.

In addition, the present invention relates to a speaker unit having improved functions and a board equipped with the speaker unit, which can improve the low-pitched sound characteristic by providing sufficient sound pressure and can be easily assembled with each other by matching lengths of exposed gold wires with each other.

2. Description of the Related Art

A TV, which is the flower of home appliances, has been developed from a Braun tube to a projection TV. Recently, a PDP TV and an LCD TV having the ultra-slim structure have been developed, so the thickness of the TV has become gradually reduced. Thus, the thickness of a speaker installed in the TV is also gradually reduced.

The audio performance of the TV corresponding to the images displayed in the TV must be improved even if the thickness of the speaker is reduced in terms of the structure. However, if the speaker has the ultra-slim structure, the sound pressure of the speaker may be lowered, so the desired low-pitched sound characteristic and the desired sound pressure may not be achieved and the audio performance corresponding to the images displayed in the TV may not be obtained.

In this regard, various methods have been proposed to provide speakers having the slim structure or the ultra-slim structure. However, they represent disadvantages in that the desired sound pressure may not be achieved in the woofer system having the low-pitched sound characteristic.

For instance, a horizontal damper has been proposed to provide the ultra-slim structure. However, such a damper may not amplify the longitudinal amplitude of the sound due to the structural limitation of the speaker having the ultra-slim structure. In addition, since the up-down vibration is accelerated, the horizontal damper is not suitable for the low-pitched sound characteristic.

In addition, since the speaker is manufactured with the ultra-slim structure, when gold wires connected to a voice coil are connected to a contact terminal by exposing the gold wires to the outside, if lengths of the gold wires are different from each other, the vibration amplitude at one side may be different from the vibration amplitude at the other side due to the thin thickness of a bobbin, which is vibrated up and down, so the gold wires must be connected to the contact terminal by matching the lengths of the gold wires with each other.

However, since the speaker unit has the ultra-slim structure, the assembling space may be narrow and the lengths of the gold wires are short, so the soldering work is very inconvenient and difficult.

Further, when the speaker unit having the ultra-slim structure is assembled with the board, a cover is mounted in a state that a coupling hole formed at an edge of a frame matches with a coupling hole formed in the board, and a screw is fastened into the coupling holes. At this time, the screw is screw-coupled into the board while passing through the coupling hole of the ultra-slim speaker located inside the cover, so the assembling work is difficult and inconvenient due to the coupling holes of the speaker unit and the board, which may be hidden during the assembling work.

In addition, when the board is coupled with the speaker unit having the ultra-slim structure, wires of the speaker unit, which are left in the free-state, are connected to external devices. Thus, as the speaker unit is vibrated, the free-state wires may be shaken while making contact with the board due to the vibration, so loud noise may be generated.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages describes below. Accordingly, an aspect of the present invention is to provide a speaker unit having the ultra-slim structure, capable of improving the low-pitched sound characteristic and the amplitude of the sound, thereby improving sound pressure.

Another aspect of the present invention is to provide a speaker unit, which can improve the low-pitched sound characteristic by providing sufficient sound pressure, can facilitate the assembling work by matching lengths of exposed gold wires with each other, and can be readily assembled with a board.

In order to accomplish the above objects, outer appearances of a damper and a frame are changed to enlarge a diameter of a voice coil in comparison with an outer diameter of a speaker, the damper is configured in a two-step structure such that a longitudinal amplitude of an upper side of the damper is increased to improve the low-pitched sound characteristic in a state in which a lower side of the damper is put on the frame, and a size of a vibration plate is enlarged to improve the low-pitched sound characteristic and sound pressure.

In addition, a flat plate is used as the vibration plate to allow the speaker unit to be fabricated in the ultra-slim structure.

In order to improve the assembling structure, according to the present invention, a pair of locking rims protrude outward to form concave valleys, which are adjacent to each other and recessed inward, in such a manner that gold wires fitted in the concave valleys can be connected to a contact terminal, thereby allowing the exposed gold wires to have the same length.

Further, according to the present invention, a plurality of coupling members are provided at edges of the frame, which are expanded outward, and coupling protrusions having coupling holes are provided in the board. The coupling protrusions are inserted into coupling holes of the coupling members so that the board can be integrally assembled with the frame.

In addition, a plurality of fixing plates, which are vertically erected, are integrally formed with the board through the injection molding process. The wires connected to the contact terminal are fitted in fixing holes of the fixing plates and thermally fused, so that noise may not be generated.

Therefore, according to the present invention, the speaker unit having the ultra-slim structure and representing the superior low-pitched sound characteristic can be provided by changing the structure of the damper, so the speaker unit may be suitable for the slim type TV.

In addition, the speaker unit having the ultra-slim structure can be provided by changing the mounting structure of the damper and the shape of the vibration plate, and the assembling work for the speaker unit may be facilitated.

Further, according to the present invention, the damper has the two-step structure, so the speaker unit suitable for expensive slim TVs can be provided and the speaker unit may represent the superior low-pitched sound characteristic and the sufficient sound pressure. In particular, since the gold wires are connected by using the locking rims formed with concave valleys, the speaker unit having the ultra-slim structure can be assembled by readily adjusting the lengths of the gold wires.

In addition, the board equipped with the speaker unit may have advantages in terms of economy and durability due to the improved assembling structure.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

FIG. 9, is assembled according to an exemplary embodiment of the present invention;

Throughout the drawings, it should be noted that like reference numbers are used to depict the same or similar elements, features, and structures.

DETAILED DESCRIPTION OF EXEMPLARY EMBODIMENTS

Figure 1:
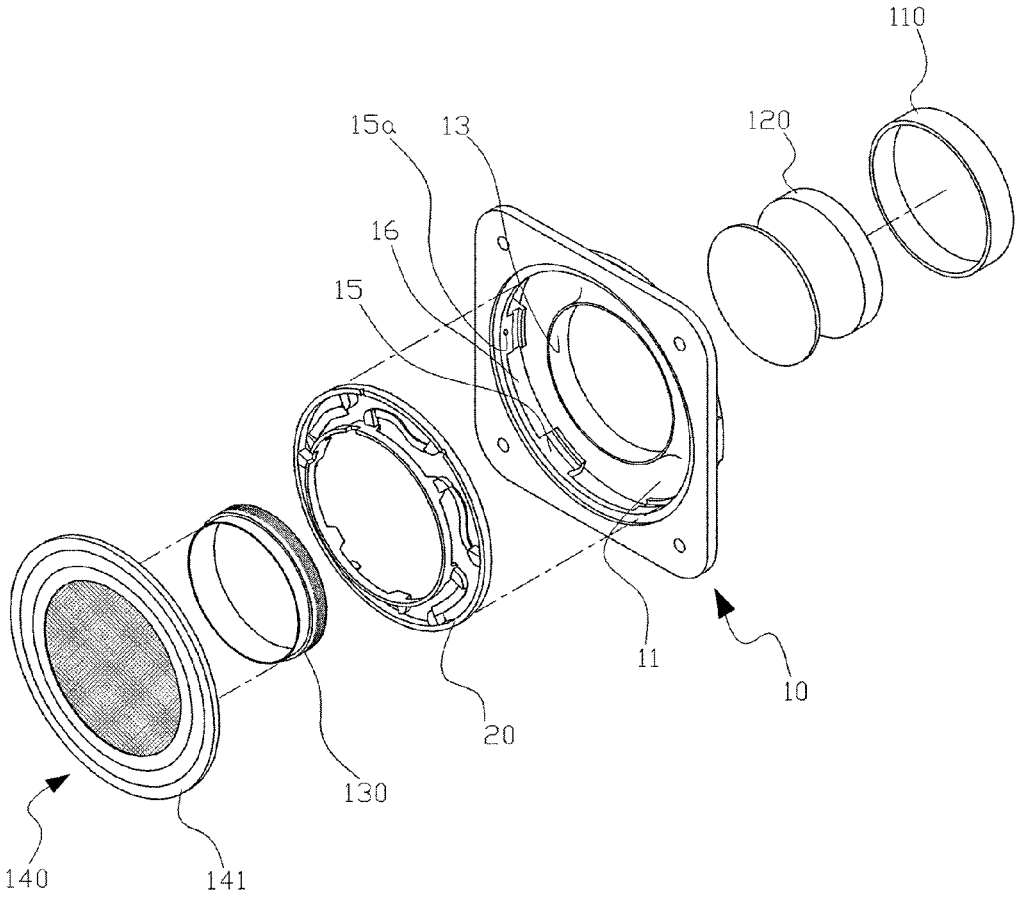
FIG. 1 is an exploded perspective view showing the assembling structure of the present invention.
Figure 2:
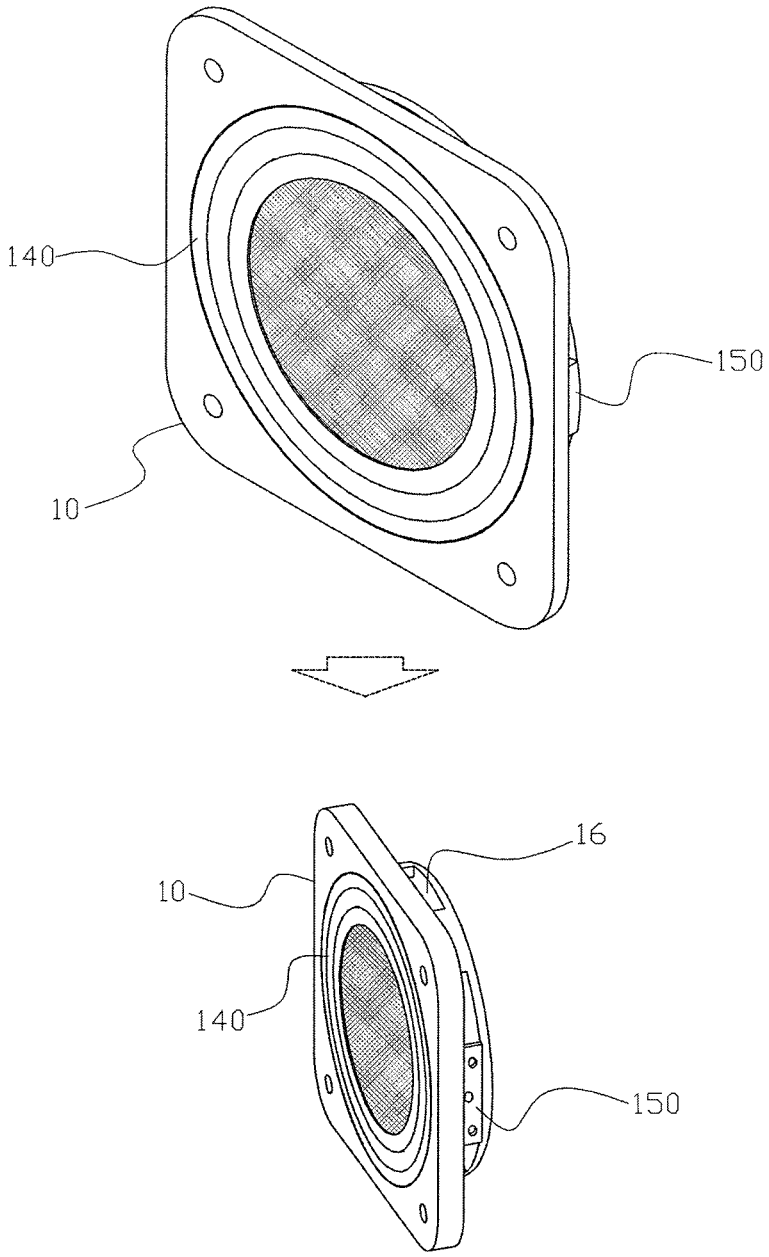
FIG. 2 is a perspective view showing an outer appearance of the speaker unit according to an exemplary embodiment of the present invention.
Figure 3:
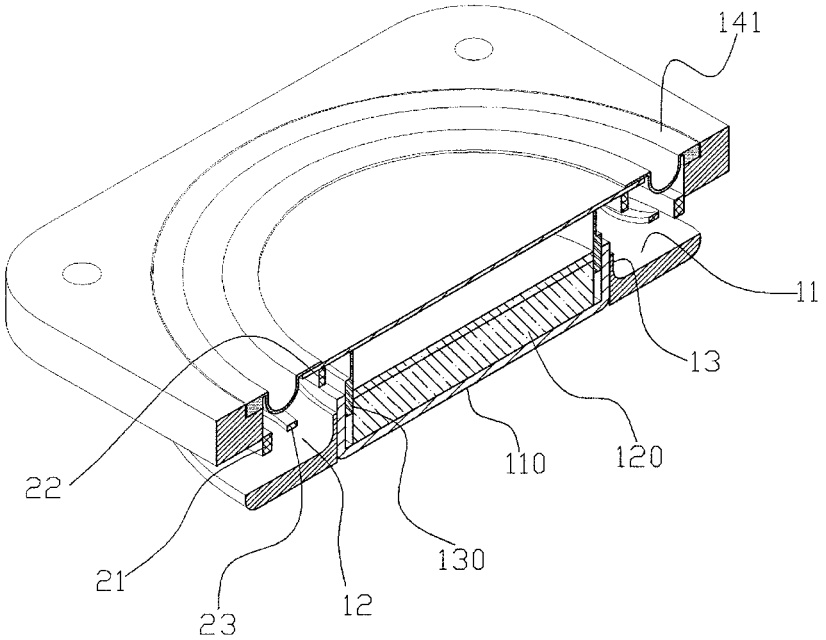
FIG. 3 is a sectional perspective view of the speaker unit according to an exemplary embodiment of the present invention.
Figure 3A:
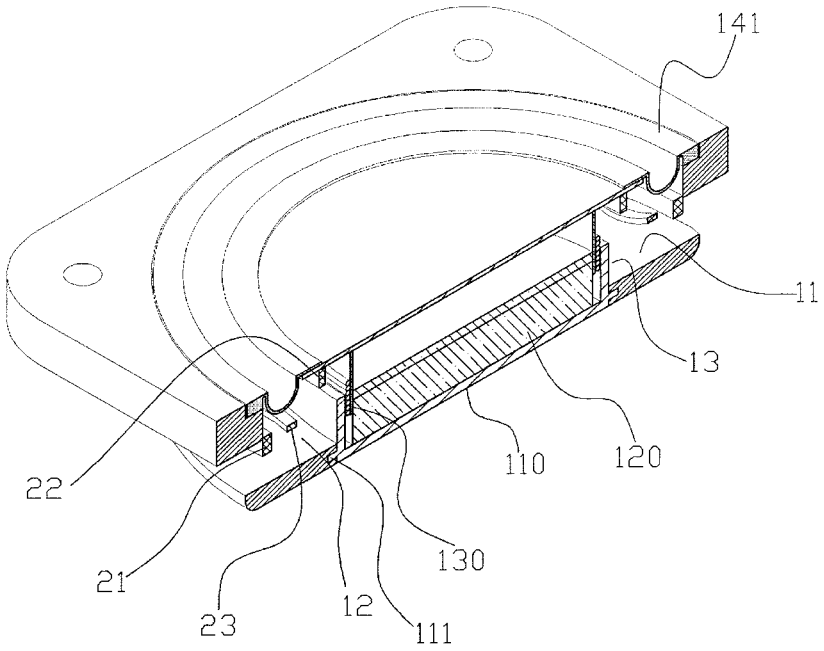
Figure 4:
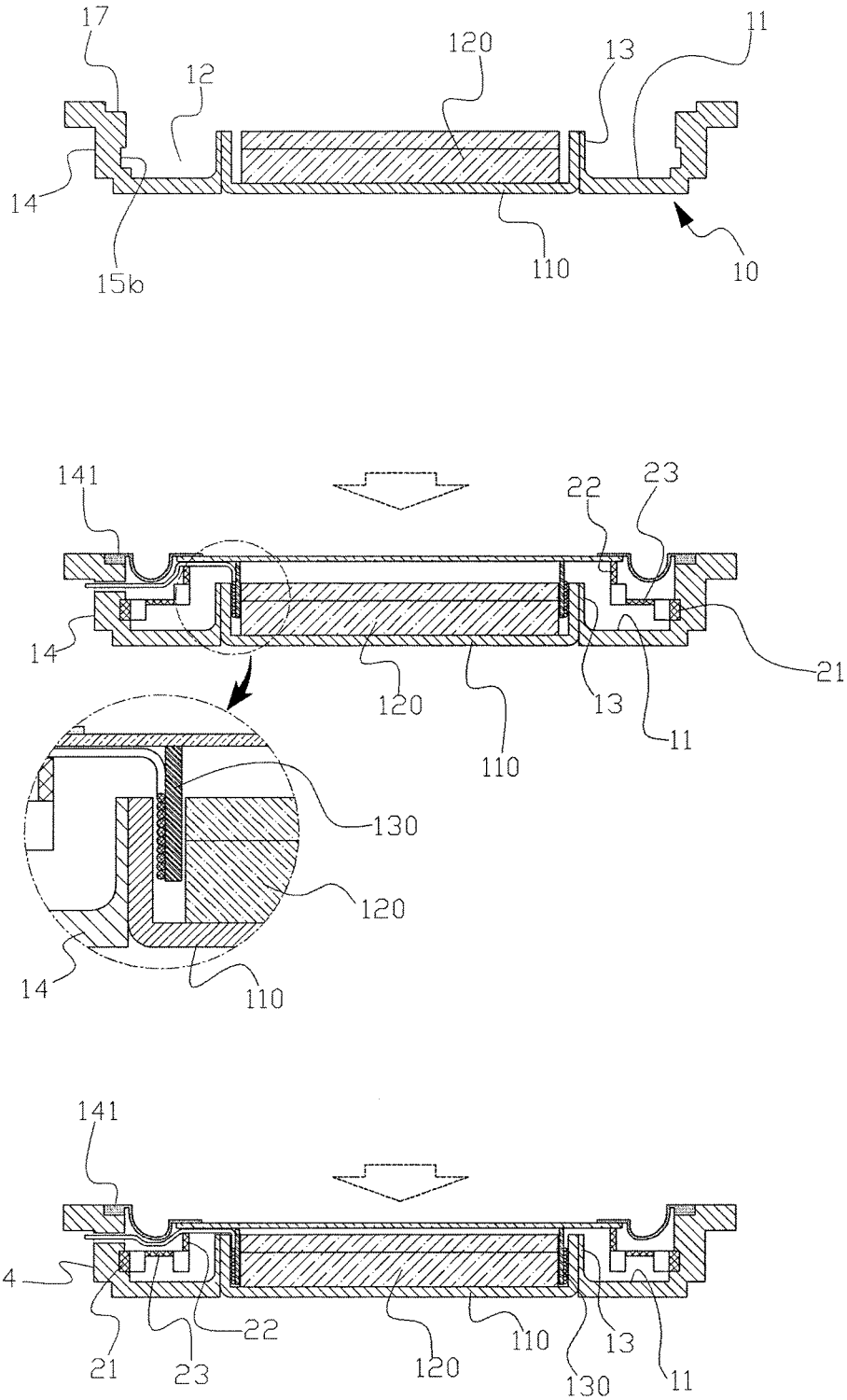
FIG. 4 is a sectional view showing a damper mounted in a frame according to an exemplary embodiment of the present invention.
Figure 5:
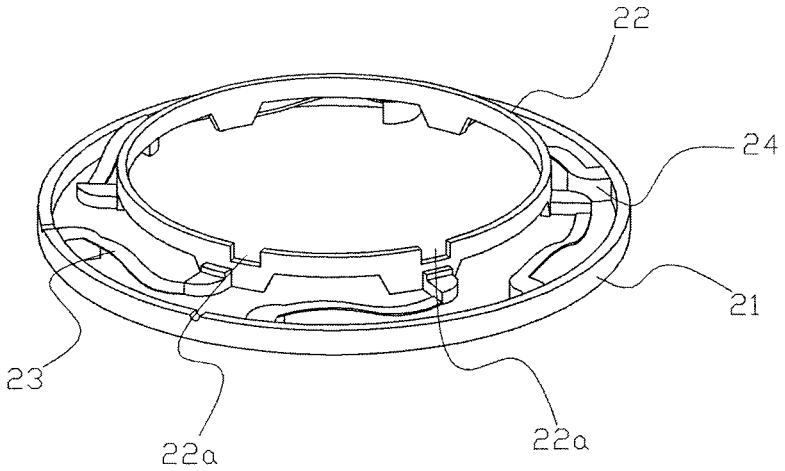
FIG. 5 is a perspective view of a damper according to an exemplary embodiment of the present invention.
Figure 6:
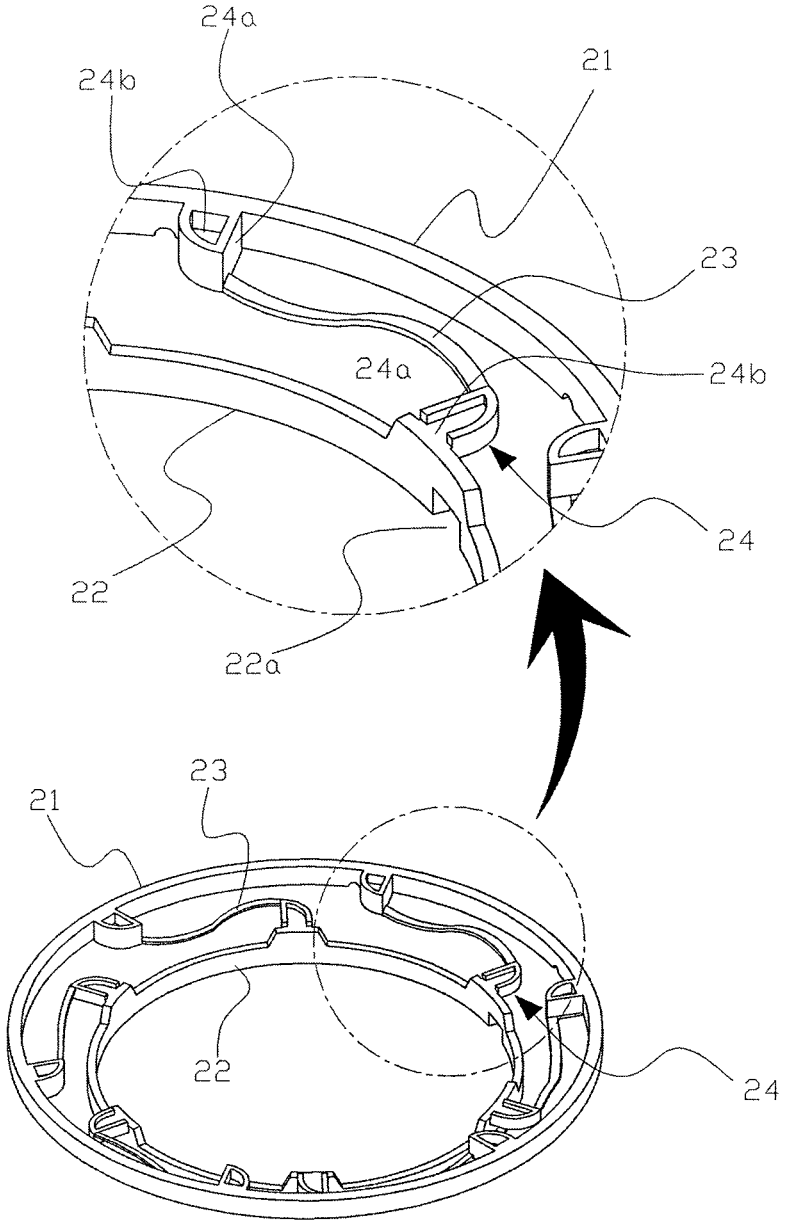
FIG. 6 is an enlarge perspective view showing a main component of a damper according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

FIGS. 1 to 8 show the structure of a speaker unit according to one exemplary embodiment of the present invention. As shown in the drawings, a yoke 110 provided therein with a permanent magnet 120 is mounted on a frame 10. The frame 10 is provided with an inner wall 13 such that an outer wall 110*a* of the yoke 110 having the permanent magnet 120 fixedly adheres to the inner wall 13 of the frame 10. The inner wall 13 protrudes toward an inside of the frame 10 (that is, a space where a damper is provided) to achieve the ultra-slim structure, and a bottom surface 11 having a space 12 is formed in the frame 10 to allow the damper 20 to be placed on an extension line of a lower end of the inner wall 13 protruding toward the inside of the frame 10. An outer wall 14 is formed outward of the inner wall 13 and the bottom surface 11 having the space 12. The outer wall 14 is formed with openings 16 defined by a plurality of support walls 15.

In addition, one of the support walls 15 constituting the outer wall 14 is formed with a terminal hole 15*a* for fixedly connecting a coil wire 131 of a voice coil 130, which is drawn through an opening 22*a* of the damper 20, to a power terminal 160 provided outside the support wall 15. Further, a locking protrusion 15*b* is provided inside the support wall 15 to fix the damper 20 placed on the bottom surface 11 having the space 12. The locking protrusion 15*b* may be slightly lifted upward to prevent the damper 20 from being shaken when the damper 20 is placed on the bottom surface 11. The structure and the position of the locking protrusion 15*b* may vary depending on applications. In order to prevent the damper 20 from being shaken, the locking protrusion 15*b* may be bonded to the bottom surface 11 or the support wall 15 constituting the outer wall 14 by an adhesive.

In addition, a rim edge 17 in the form of a stepped portion is provided at an outer peripheral portion of the frame 10 such that an edge 141 of the vibration plate 140 is fixedly bonded to the rim edge 17.

Further, the damper 20 includes an outer rim 21 and an inner rim 22. The outer rim 21 of the damper 20 is fixedly placed on the bottom surface 11 of the frame 10 having the space 12 or fixed to the support wall 15 constituting the outer wall 14. The inner rim 22 of the damper 20 is fixedly bonded to the vibration plate 140 to which the voice coil 130 is bonded.

The outer rim 21 is placed on the bottom surface 11 having the space 12 and fixedly bonded thereto, or fixedly locked with the locking protrusion 15*b* of the support wall 15 while being slightly lifted upward from the bottom surface 11 to prevent the damper 20 from being shaken caused by the vibration. In order to allow the inner rim 22 to be lifted upward from the bottom surface 11 by a predetermined distance corresponding to the maximum amplitude of the up-down vibration, the inner rim 22 is located inside and above the outer rim 21 while being spaced apart from the outer rim 21 by a predetermined distance as possible. In this state, crank-shaped elastic bars 23 are connected to an upper end of the outer rim 21 and a lower end of the inner rim 22, so the inner rim 22 can be vibrated up and down with the maximum amplitude.

In addition, according to the present invention, the damper 20 is fabricated through the injection molding process by using various plastics to achieve the low weight and to prevent the shape deformation. However, the injection molding may not intend to limit the scope of the present invention, and the damper 20 may be fabricated by using a metal or various materials other than the plastic.

In order to allow the damper 20 to have a minimum weight as well as predetermined strength and durability, the outer rim 21 and the inner rim 22 are fabricated by using a plate having a predetermined width, and the outer rim 21 and the inner rim 22 are vertically erected for vertical reinforcement. The elastic bar 23 is horizontally laid perpendicularly to the outer rim 21 and the inner rim 22 to maximize the elasticity. Thus, when the elastic bar 23 is vibrated up and down, the upright strength of the outer rim 21 and the inner rim 22 can be maintained and the elasticity of the elastic bar 23 is improved.

In addition, the elastic bar 23, which is horizontally laid, is located between the outer rim 21 and the inner rim 22 while being bent along the outer peripheral portions of the outer rim 21 and the inner rim 22, so the inner rim 22 can precisely maintain the longitudinal amplitude when the inner rim 22 is vibrated up and down. In order to allow the elastic bar 23 to be located along the outer peripheral portions of the outer rim 21 and the inner rim 22, reinforcement members 24, which are vertically extended, are provided at connection parts of the elastic bar 23 with respect to the outer rim 21 and the inner rim 22 and the elastic bars 23 extend from the reinforcement members 24 in a curved shape, so that the amplitude can be precisely maintained upon the up-down vibration of the inner rim 22.

Further, according to the present invention, the reinforcement member 24 is formed with a weight-reduction part to maintain the reinforcement member 24 at the light weight upon the up-down vibration of the inner rim 22. In addition, the reinforcement member 24 includes a reinforcement rib 24*a* and a recess 24*b* to prevent the twist when the elastic bar 23, which is horizontally curved, is accurately operated. The elastic bar 23, which is horizontally curved, is connected to a front end of the recess 24*b*.

In addition, the coil wire 131 from the voice coil 130 fixedly bonded to the vibration plate 140 is drawn through the opening 22*a* of the inner rim 22 of the damper fixed to the vibration plate 140 and is connected to the power terminal 160 connected to the outer portion of the support wall 15 through the terminal hole 15*a* formed in one of the support walls 15 constituting the outer wall 14 of the frame 10.

Figure 7:
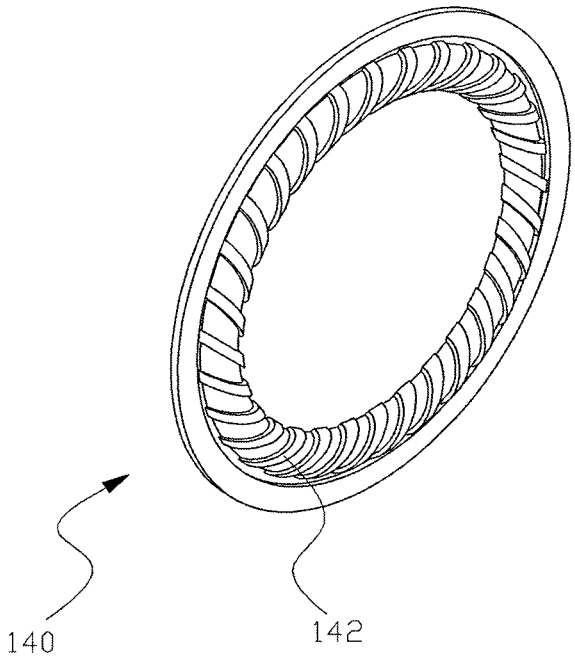
FIG. 7 is a perspective view showing a vibration plate according to an exemplary embodiment of the present invention.
Figure 8:
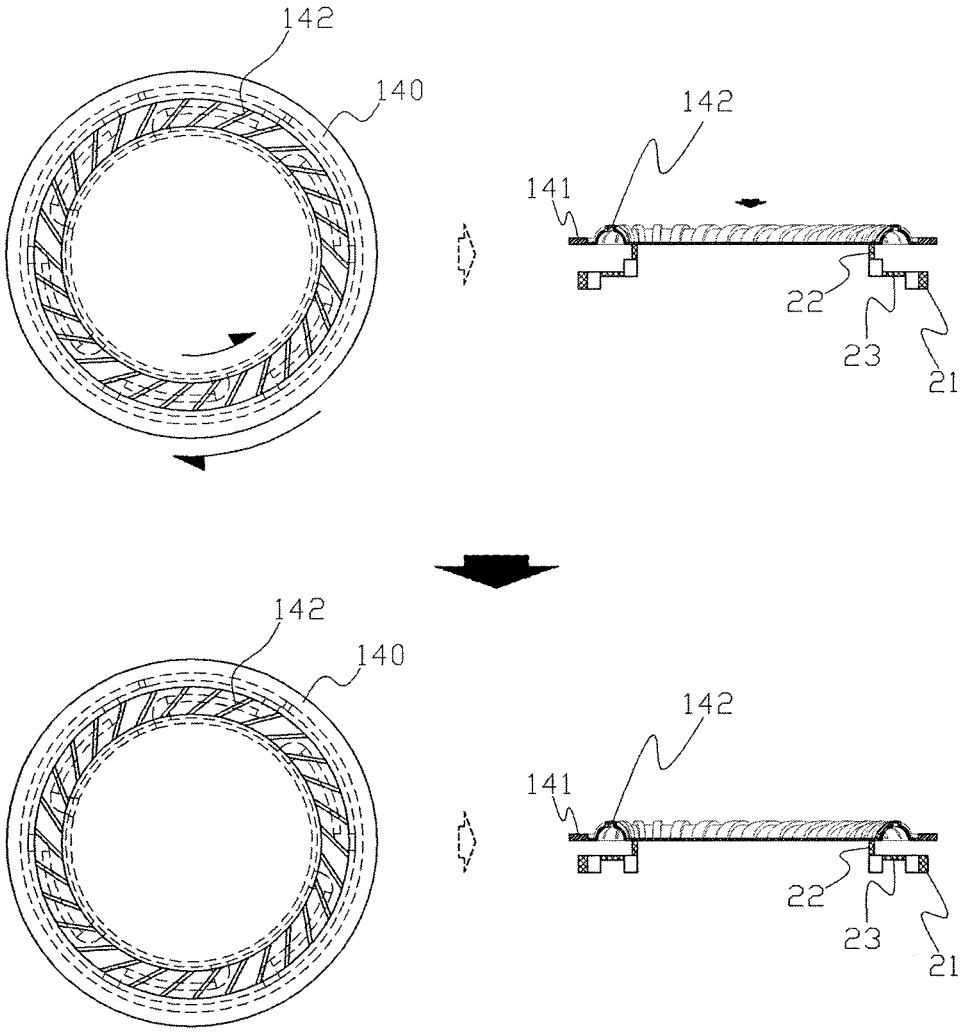
FIG. 8 is a view showing a vibration plate and a damper which resist against twist according to an exemplary embodiment of the present invention.
Figure 9:
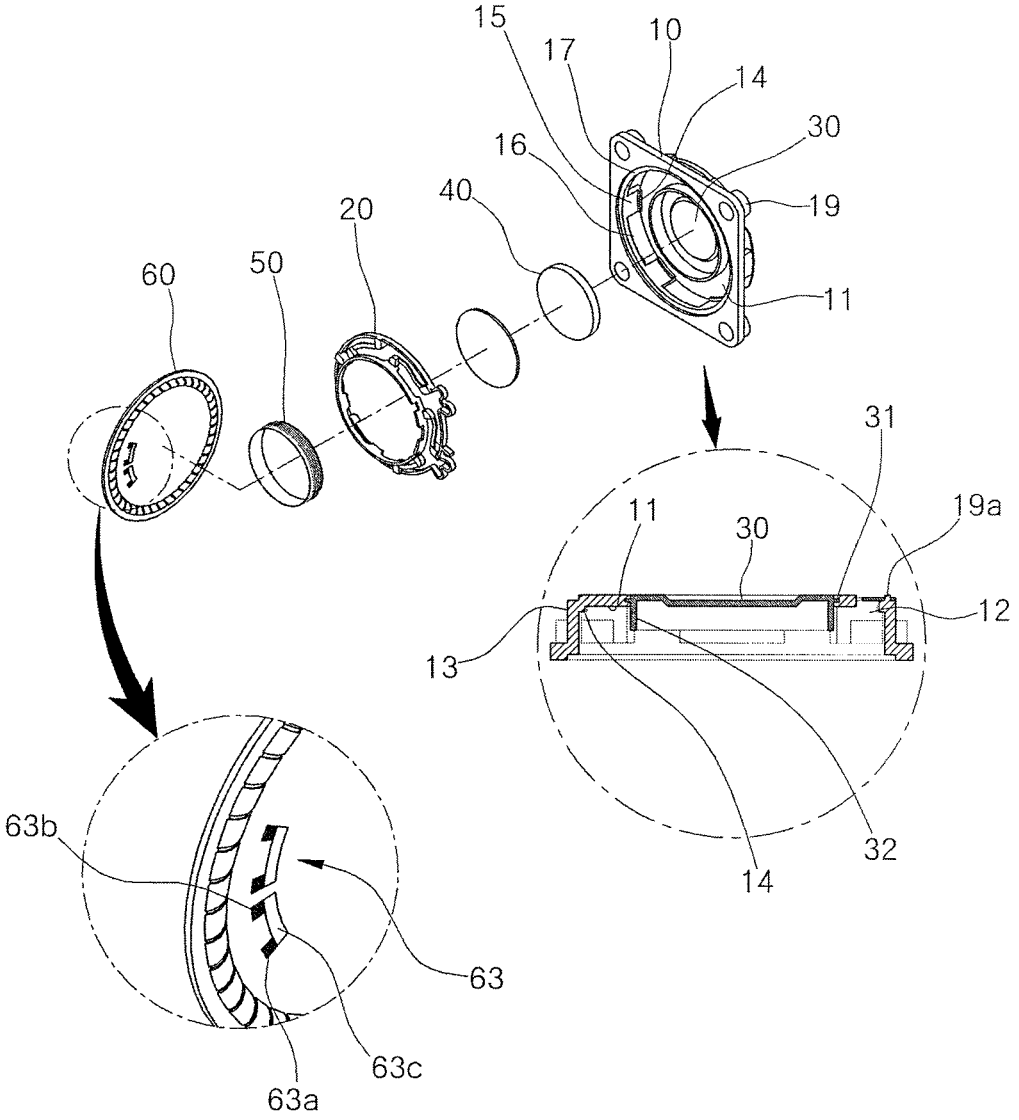
FIG. 9 is an exploded perspective view showing an ultra-slim speaker unit having a damper according to another exemplary embodiment of the present invention.
Figure 10:
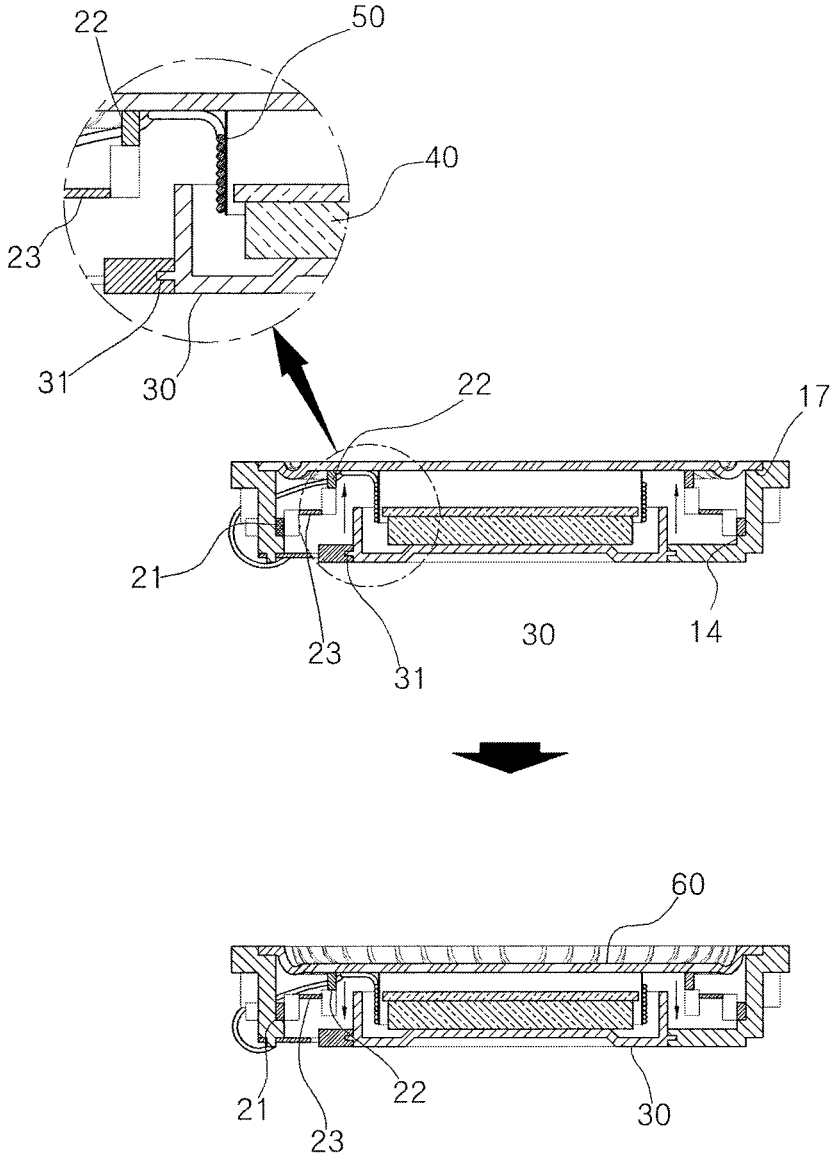
FIG. 10 is a sectional view taken when a speaker unit, for example the speaker unit shown
Figure 11:
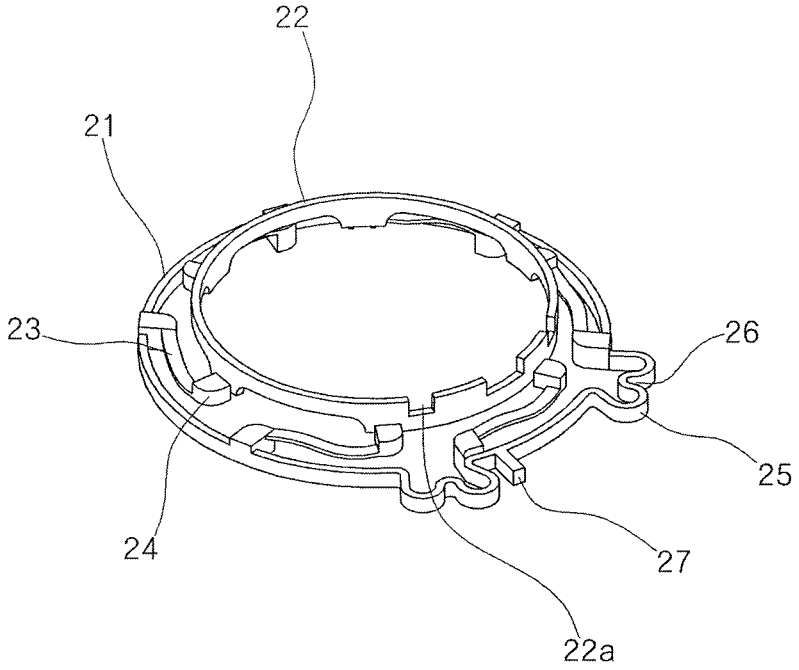
FIG. 11 is a perspective view showing a damper according to another exemplary embodiment of the present invention.
Figure 12:
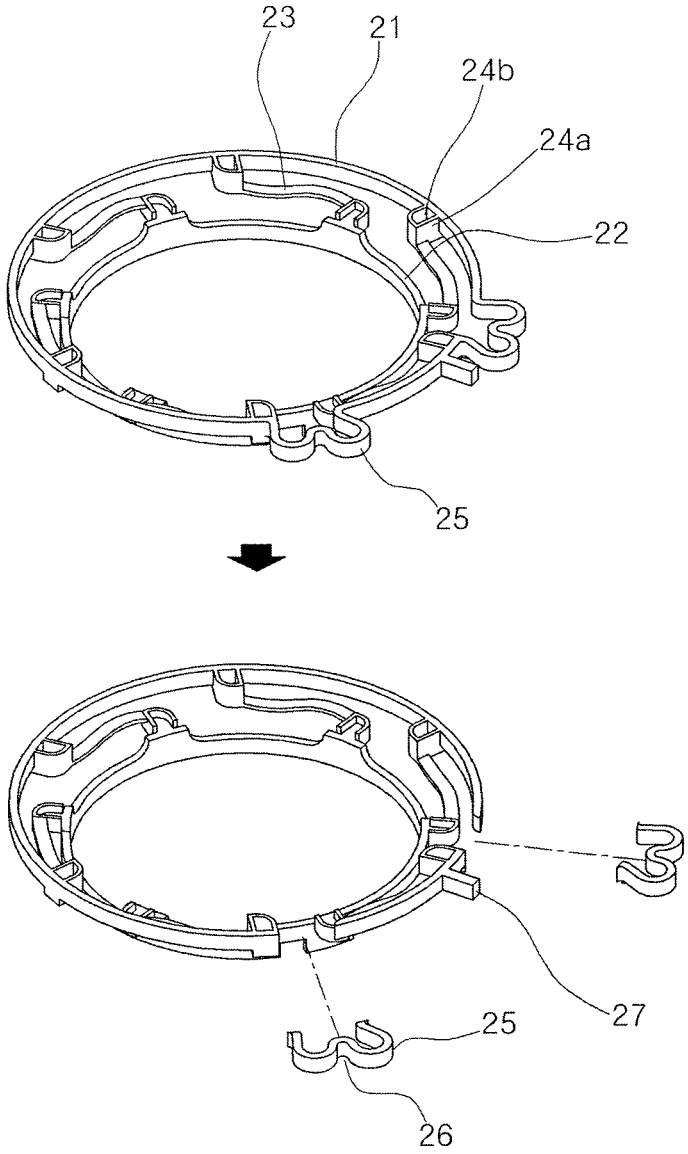
FIG. 12 is a view showing a usage state of a damper, for example the damper shown in FIG. 11, according to an exemplary embodiment of the present invention.

Referring to FIG. 7, inclined protrusions 142 are provided at one side of the edge 141 of the vibration plate 140. In this case, the elastic bar 23 of the damper 20 extends in one direction while varying the height thereof from the inner rim 22 to the outer rim 21, so it is possible to resist against the twist upon the up-down vibration.

In addition, according to the present invention, the vibration plate 140 is fabricated by using a flat plate. In this case, the speaker unit may have the ultra-slim structure. Since the vibration plate 140 is directly bonded to the inner rim 22 of the damper 20, it is possible to use the vibration plate 140 having a larger diameter, so the rate of the longitudinal amplitude can be reduced. In addition, since the vibration plate 140 is connected to the damper 20 including the outer rim 21 and the inner rim 22 having the height difference, the vibration plate 140 may not make contact with the yoke 110 upon the up-down vibration. In addition, since the inner rim 22 of the damper 20 is vibrated up and down within the outer rim 21, the amplitude of the vibration of the vibration plate 140 may be increased, so that the low-pitched sound characteristic can be improved. Further, since the bobbin 130*a* of the voice coil 130 may have the larger diameter, the length of the coil 130*b* wound around the bobbin 130*a* may be increased, so that the sound pressure can be improved.

Further, the damper 20 is fabricated by using a conductive material having a light weight, so the coil of the voice coil can be directly connected to the damper in a simple way, so that the assembling process for manufacturing the speaker unit can be simplified.

However, the variation of the material may not lead to the variation of the object of the present invention. The variation of the material and the structure is possible within the scope of the present invention.

FIGS. 9 to 14 show a speaker unit having the ultra-slim structure according to another embodiment of the present invention. As shown in the drawings, the yoke 110 provided therein with the permanent magnet 120 is integrally formed with the frame 10 through the insert injection molding process, so the assembling work can be improved. To this end, a projection rim 111 is provided at the lower end of the yoke 110 and the frame 10 is injection molded while surrounding the projection rim 111, so the bonding process can be omitted and the yoke 110 can be securely fixed to the frame 10.

In addition, a terminal 150 is provided on the vibration plate 140 and the coil wire 131 of the coil 130*b* wound around the bobbin 130*a* is connected to the terminal 150. In addition, gold wires 162 connected to the power terminal 160 are formed in the terminal 150.

To this end, the coil wire 131 is directly connected to one terminal 150*a* of the terminal 150 formed in the vibration plate 140 in such a manner that the coil 130*b* wound around the bobbin 130*a* can be prevented from being released by the coil wire 131 and the assembling work can be facilitated. In addition, the other terminal 150*b* is connected to the one terminal 150*a* through a flexible board 150*c* while forming an electrode, so the gold wires 162 can be connected to the other terminal 150*b* such that the gold wire 162 can be connected to the power terminal 160 connected to the external power source.

Thus, the coil wire 131 can be easily connected to the gold wires 162, which are used for connection with the external power source, and the power terminal 160 and the gold wires 162 can be easily welded with each other during the assembling work.

In addition, a rim mount 17 is formed at an upper end of the outer wall 14 of the frame 10 and the edge 141 of the vibration plate 140 is placed on the rim mount 17. In addition, coupling members 19 having coupling holes 19*a* are provided at edges of the frame 10, respectively. Coupling protrusions 203 of the board 200 are inserted into the coupling holes 19*a*, so the board 200 can be simply integrated with the frame 10.

Further, a plurality of locking rims 25 protrude in adjacent to each other from the outer rim 21 of the damper 20 while forming a concave valley 26 therein. When the gold wires 162 connected to the vibration plate 140 are assembled with the power terminal, the gold wire 162 exposed out of the damper 20 is fitted in the concave valley 26 and the other end of the gold wire 162 is connected to the power terminal 160. Thus, the exposed gold wires 162 can be connected to the power terminal in the same length.

The number of concave valleys 26 formed in the outer rim 21 may correspond to the number of gold wires 162. A locking plate 27 is provided between the locking rim 25 and another locking rim 25*a* while interposing the support walls 15 constituting the outer wall 14 therebetween. The locking plate 27 is exposed to the outside through the opening 16 and adheres to the support wall 15. In this state, each locking rim 25 is exposed out of the opening at the same distance about the support wall 15.

At this time, an upper end of the opening 16 is partially cut and an upper end of the support wall 15 is located in the cutting part of the opening 16. A polygonal fixing protrusion 18 protrudes outward from the upper end of the support wall 15 and a groove 161 is formed in the power terminal 160 corresponding to the fixing protrusion 18. Thus, the power terminal 160 is fitted with the fixing protrusion 18 so that the assembling work can be simplified.

Figure 13:
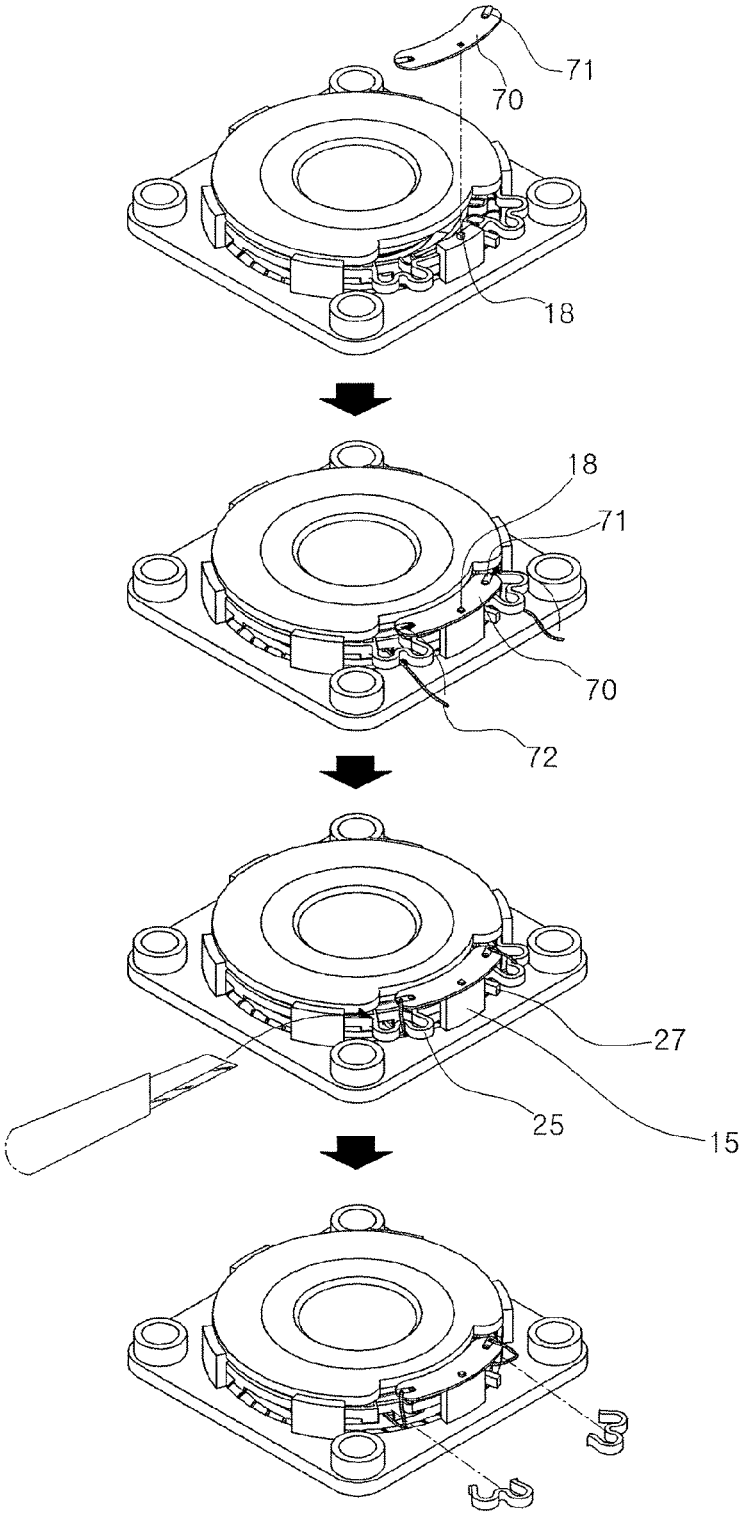
FIG. 13 is a perspective view showing the connection procedure of gold wires to a power terminal by using a damper according to an exemplary embodiment of the present invention.
Figure 14:
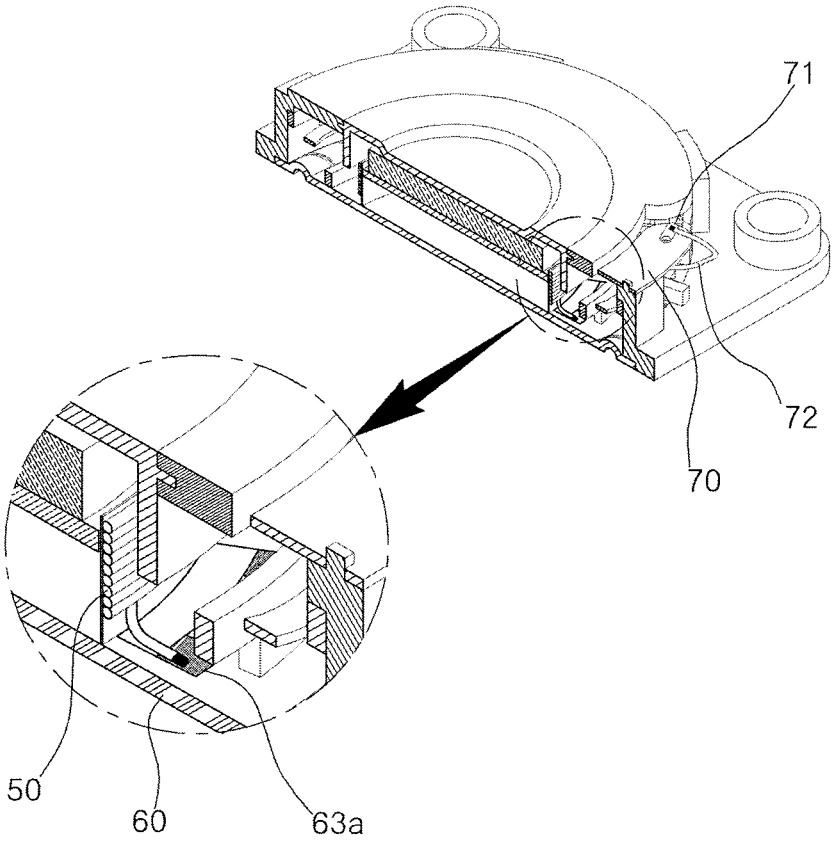
FIG. 14 is a sectional perspective view showing a coil wire connected to a terminal according to an exemplary embodiment of the present invention.
Figure 15:
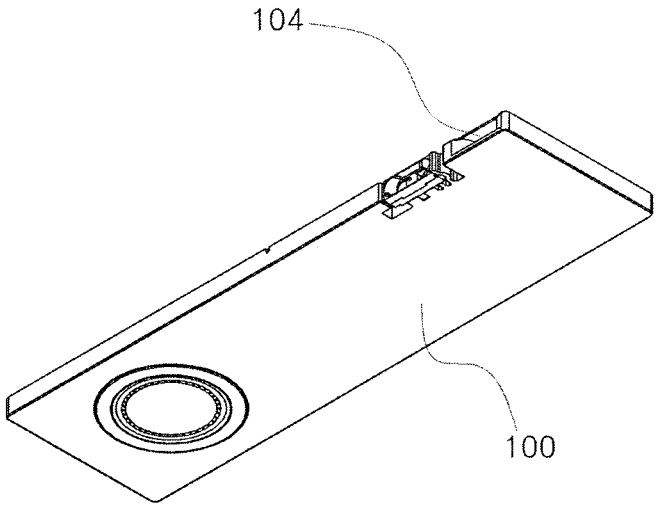
FIG. 15 is a perspective view showing a board equipped with a speaker unit according to an exemplary embodiment of the present invention.
Figure 16:
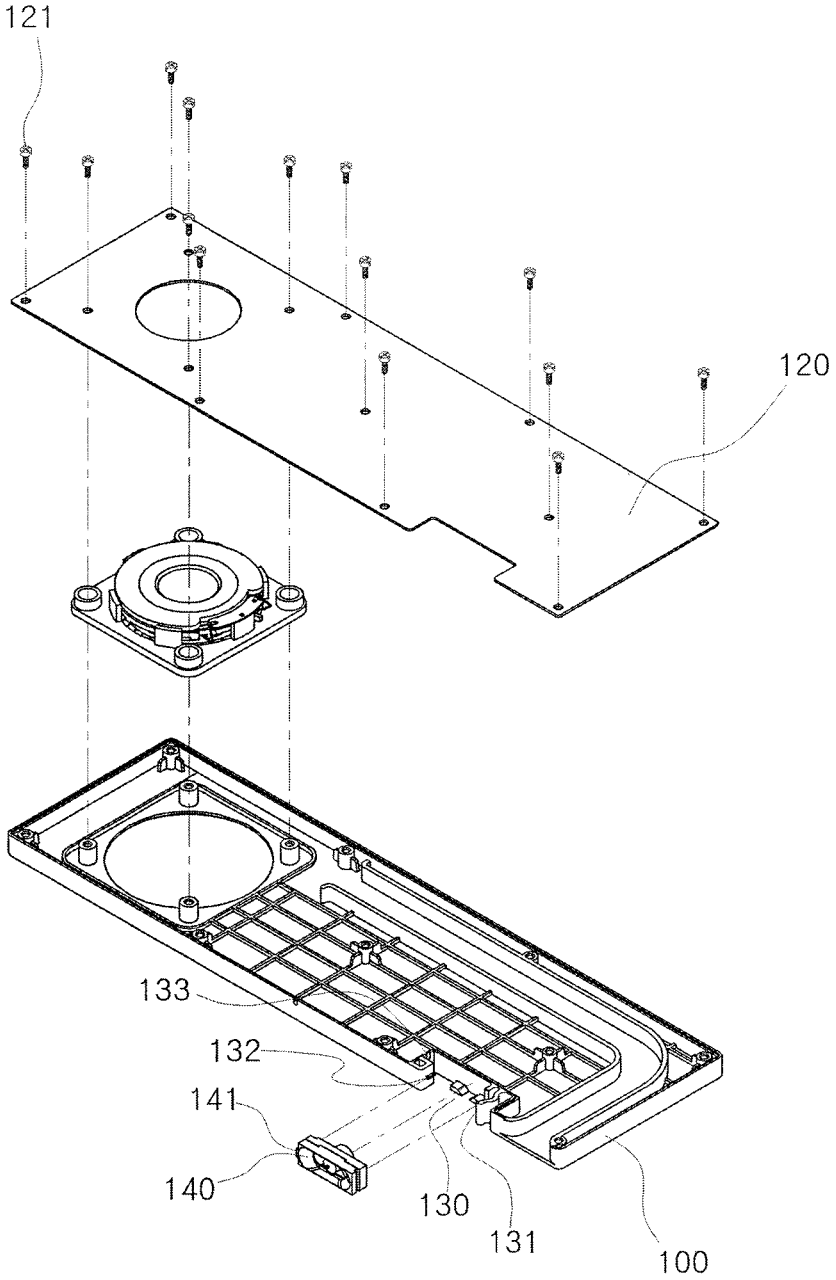
FIG. 16 is an exploded perspective view showing the assembling process a speaker unit to a board according to an exemplary embodiment of the present invention.
Figure 17:
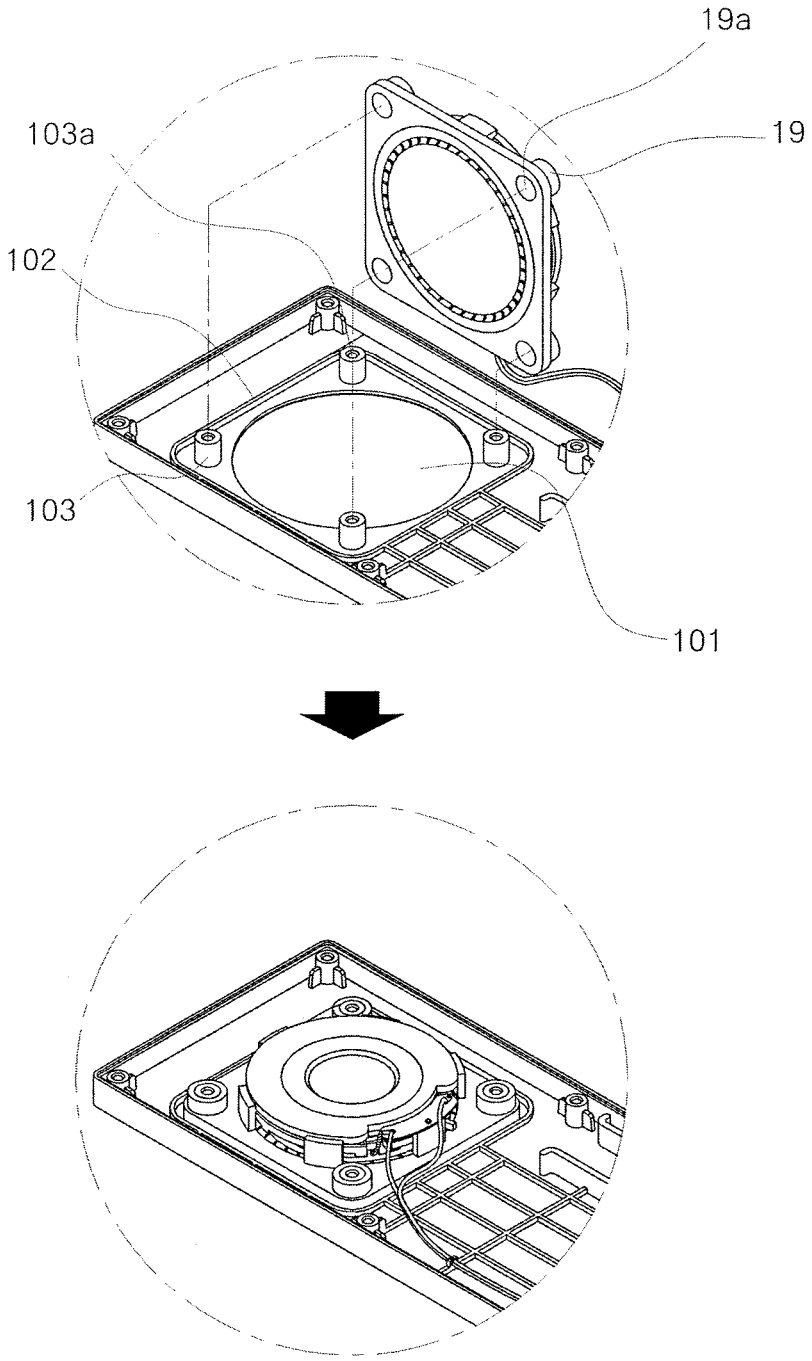
FIG. 17 is a perspective view showing the assembling procedure of a frame of a speaker unit to a board according to an exemplary embodiment of the present invention.

FIG. 13 shows the procedure for connecting the gold wires 162 to the power terminal 160. First, the damper 20 is fixed to the bottoms surface 11 of the frame 10 and the voice coil 130 is assembled with the vibration plate 140. Then, the gold wires 162 are exposed out of the frame 10 through the openings formed in the support walls 15 constituting the outer wall 14.

At this time, if the power terminal 160 is assembled on the support walls 15 by the coupling between the fixing protrusion 18 and the groove 161, since the opening is partially cut according to the size of the power terminal, the locking plate 27, which is exposed out of the opening 16 together with the locking rim 25 of the damper 20, fixedly adheres to the support wall 15, so that the locking rims 25 exposed out of the openings 16 may be located at left and right about the power terminal.

In addition, in a state that the exposed gold wires 162 are fixedly fitted in the concave valleys 26 of the locking rims 25, other ends of the gold wires 162 are fixedly soldered to the power terminal 160, and the locking rims 25 are cut, so that the gold wires 162 exposed out of the damper 20 may be connected to the power terminal 160 in the same length.

Therefore, according to the present invention, when the speaker having the ultra-slim structure is fabricated, the problem that the vibration amplitude at one side of the gold wire is different from the vibration amplitude at the other side of the gold wire caused by the difference in length of the gold wires due to the thin thickness of the bobbin and the structural limitation can be solved and the assembling work can be performed without inconvenience.

FIGS. 15 to 18 show the board assembled with the speaker unit having the ultra-slim structure. The board is formed at the center thereof with an opening 201 and provided at the outer peripheral portion thereof with a fixing rim 202 surrounding the outer peripheral portion of the speaker unit and coupling protrusions 203 having coupling holes 203*a*. Thus, when the speaker is assembled with the board 200, the coupling protrusions 203 of the board 200 are inserted into the coupling members 19 of the frame 10. In this state, assembling screws 211 are screw-coupled into the coupling holes 203*a* of the board 200 by passing through a cover 210, so that the speaker unit having the ultra-slim structure can be easily assembled with the board at a time.

In addition, a ventilation port 204 is formed at one side of the board 200 and a ventilation path 205 having a curved structure is formed while surrounding the ventilation port 204. Thus, air can be sufficiently supplied, so that the output of the sound can be increased by expanding the sound.

Figure 18:
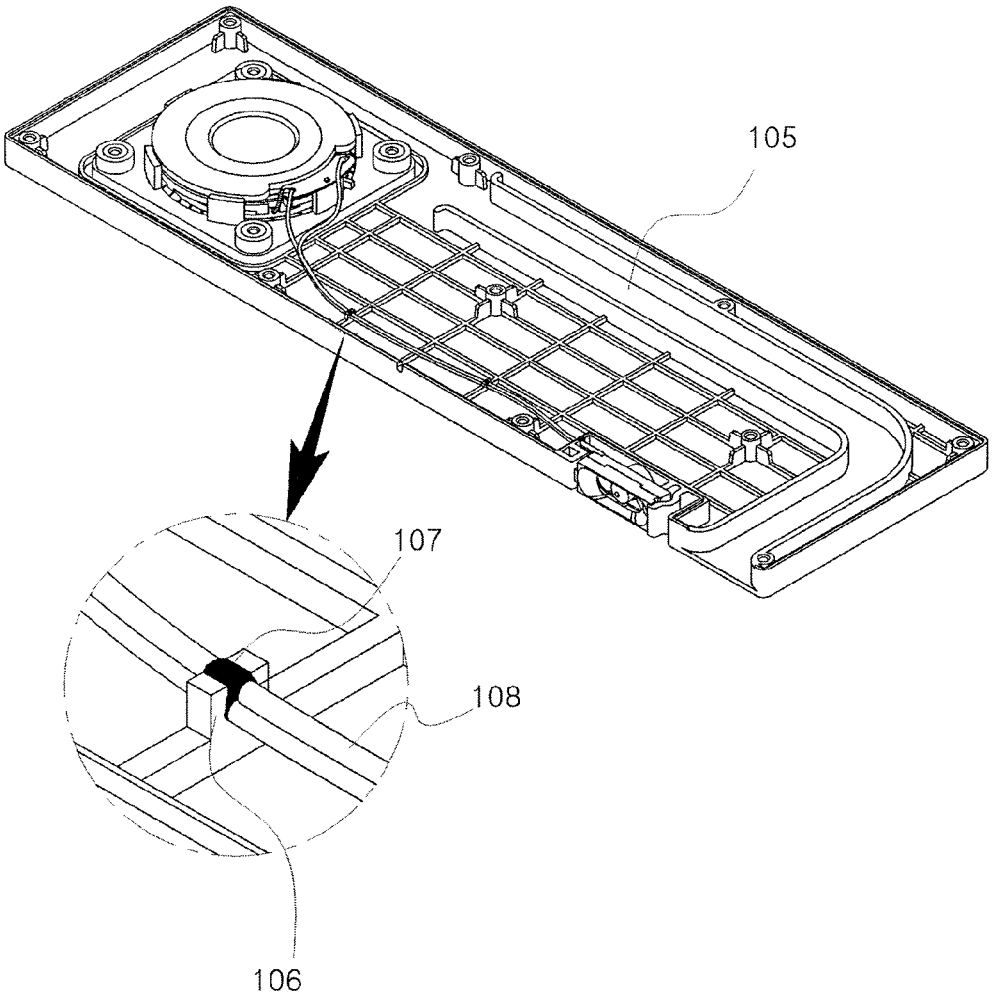
FIG. 18 is a perspective view showing a fixed state of a wire according to an exemplary embodiment of the present invention.

Further, as shown in FIG. 18, a plurality of fixing plates 206 are vertically erected on the bottom of the board 200. The fixing plates 206 are integrally formed with the board 200 through the injection molding process. The fixing plates 206 have fixing grooves 207 and electric wires 208 connected to the power terminal 160 are fixedly inserted into the fixing grooves 207. In this state, the electric wires 208 are fused to the fixing grooves 207 by applying heat, so the electric wires 208 leaving in the free-state (the state to be moved freely) may be tightly pulled, thereby preventing the noise caused by the movement of the electric wires 208 due to the vibration.

In addition, fixing grooves are formed in the reinforcement ribs provided inside the board 200 of the present invention to prevent the board 200 from being twisted, and the electric wires 208 are fitted in the fixing grooves and thermally fused to the fixing groove, thereby obtaining the same effect as described above.

Further, a recess 230 is formed at one side of the board 200 and the electric wires 208 are fitted in a fixing member 240 and exposed to the outside. That is, a stepped electric member 231 is provided at one side of the recess 230, and a guide 232 and an expose hole 233 are formed at the other side of the recess 230. Thus, in a state that the electric wires 208 are fitted in the fixing member 240 through the expose hole 233, if the fixing member 240 is introduced into the recess 230, the elastic member is widened and a guide plate 241 of the fixing member 240 and the guide 232 are engaged with each other so that the guide plate 241 and the guide 232 can be fixedly adhered with each other. At this time, the electric wires 208 are exposed to the outside through a groove formed in the fixing member 240.

Therefore, the present invention can improve the low-pitched sound characteristic by providing sufficient sound pressure and the speaker can be easily assembled with the board by matching lengths of exposed gold wires with each other.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A speaker unit having an ultra-slim structure capable of improving low-pitched sound characteristics and sound pressure, the speaker unit comprising:

a frame in which a yoke provided therein with a permanent magnet is accommodated on a center of the frame; and a damper accommodated on a bottom surface of the frame, wherein an outer wall is erected at an outer peripheral portion of the frame having the yoke such that a space is formed between a bottom surface of the frame and the outer wall, a rim edge is provided at an upper end of the outer wall such that an edge of a vibration plate is placed on the rim edge, the damper has a two-step structure and is divided into an outer rim and an inner rim, which have mutually different diameters, and the outer rim is placed on the bottom surface of the frame, the outer rim placed on the bottom surface of the frame is connected to the inner rim located higher than the outer rim by an elastic bar having a crank shape, one end of the elastic bar that connects the outer rim with the inner rim is connected to an upper end of the outer rim and a remaining end of the elastic bar is connected to a lower end of the inner rim to maximize an amplitude, the outer rim and the inner rim of the damper are made from a plate having a predetermined width and vertically erected for vertical reinforcement, and the elastic bar is horizontally laid perpendicularly to the outer rim or the inner rim in order to improve elasticity thereof, the edge of the vibration plate is fixed to the rim edge of the frame in a state that the vibration plate is fixedly bonded to an upper end of the inner rim, a voice coil is fixed to the vibration plate and accommodated in the inner rim to move up and down while being embedded between the yoke and the permanent magnet, and wherein a plurality of support walls are provided in the outer wall of the frame and opened by openings to fix the damper and to treat the sound pressure generated upon the up-down vibration of the vibration plate.

2. The speaker unit of claim 1, wherein a reinforcement member, which is vertically extended, is provided at connection parts of the elastic bar with respect to the outer rim and the inner rim in order to precisely maintain a longitudinal amplitude upon up-down vibration of the inner rim and the elastic bar extends from the reinforcement member in a curved shape along outer peripheral portions of the outer rim and the inner rim.

3. The speaker unit of claim 1, wherein a reinforcement member, which is vertically extended, is provided at connection parts of the elastic bar with respect to the outer rim and the inner rim in order to precisely maintain a longitudinal amplitude upon up-down vibration of the inner rim and the elastic bar extends from the reinforcement member in a curved shape along outer peripheral portions of the outer rim and the inner rim.

4. The speaker unit of claim 2, wherein the reinforcement member includes a reinforcement rib and a recess to prevent twist of the elastic bar, which is horizontally curved, and to ensure an accurate operation of the elastic bar, and the elastic bar is horizontally connected to a front end of the recess.

5. The speaker unit of claim 1, wherein an inclined protrusion is formed at an edge of the vibration plate while being inclined in one direction to resist against twist in cooperation with the elastic bar of the damper.

6. The speaker unit of claim 1, wherein a locking protrusion is provided at a lower end of the yoke, and the locking protrusion is formed on the bottom surface of the frame through an insert molding process.

7. The speaker unit of claim 1, wherein a coil wound around a bobbin of the voice coil is connected to one terminal formed in the vibration plate, and the other terminal, to which gold wires are connected, is connected to the one terminal through a flexible board while forming an electrode.

8. The speaker unit of claim 5, wherein a coil wound around a bobbin of the voice coil is connected to one terminal formed in the vibration plate, and the other terminal, to which gold wires are connected, is connected to the one terminal through a flexible board while forming an electrode.

9. The speaker unit of claim 1, wherein a pair of locking rims, which are adjacent to each other, protrude outward from the outer rim and concave valleys are formed at centers of the locking rims.

10. The speaker unit of claim 1, wherein upper portions of a pair of openings, which are adjacent to each other, are partially cut so that an upper end of the support wall located in a middle region is exposed to an outside, a polygonal fixing protrusion protrudes from the upper end of the support wall, and a groove of a connection plate provided with a contact terminal is fixedly fitted with fixing protrusion.

11. The speaker unit of claim 10, wherein, in a state that the locking rim formed with the concave valley is exposed out of the opening, a locking plate is provided between the locking rim and another locking rim, and the locking plate allows each locking rim to be exposed out of the opening at the same distance about the support wall while adhering to the support wall.

12. The speaker unit of claim 1, wherein a plurality of coupling members are provided at corners of the frames, which are expanded outward, the speaker unit further comprises a board provided with coupling protrusions having coupling holes, and the coupling protrusions are inserted into coupling holes of the coupling members so that the board is integrally assembled with the frame.

13. The speaker unit of claim 12, wherein an incised ventilation port is formed around a fixing rim of the board, and a curved ventilation path is provided to surround the ventilation port.

14. The speaker unit of claim 13, wherein a plurality of fixing plates, which are vertically erected, are integrally formed with the board through an injection molding process, and electric wires connected to a contact terminal are fused to the fixing plates in a state that the electric wires are fitted in fixing grooves.

* * * * *